US011428403B2

(12) United States Patent
Park et al.

(10) Patent No.: US 11,428,403 B2
(45) Date of Patent: Aug. 30, 2022

(54) GAS FURNACE

(71) Applicant: LG ELECTRONICS INC., Seoul (KR)

(72) Inventors: Janghee Park, Seoul (KR); Jusu Kim, Seoul (KR); Hansaem Park, Seoul (KR); Yongki Jeong, Seoul (KR); Doyong Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/898,668

(22) Filed: Jun. 11, 2020

(65) Prior Publication Data

US 2020/0393125 A1 Dec. 17, 2020

(51) Int. Cl.

| | |
|---|---|
| ***F23D 14/02*** | (2006.01) |
| ***F23C 3/00*** | (2006.01) |
| ***F23C 5/00*** | (2006.01) |
| ***F23C 6/04*** | (2006.01) |
| ***F23D 14/62*** | (2006.01) |
| ***F23D 99/00*** | (2010.01) |
| ***F23D 14/64*** | (2006.01) |
| ***F24H 3/06*** | (2022.01) |

(52) U.S. Cl.

CPC ..... *F23D 14/02* (2013.01); *F23C 3/002* (2013.01); *F23C 5/00* (2013.01); *F23C 6/04* (2013.01); *F23D 14/62* (2013.01); *F23D 91/02* (2015.07)

(58) Field of Classification Search

CPC .... F23C 3/002; F23C 5/00; F23C 6/04; F23D 14/02; F23D 14/62; F23D 14/64; F23D 2203/102; F23D 91/02; F24H 3/065

See application file for complete search history.

(56) References Cited

U.S. PATENT DOCUMENTS

| | | | | |
|---|---|---|---|---|
| 2,658,504 | A * | 11/1953 | Jaye | F24H 3/105 126/110 R |
| 3,837,789 | A * | 9/1974 | Schindler | F23D 14/105 431/354 |
| 6,004,129 | A * | 12/1999 | Carbone | F23D 14/02 431/326 |
| 2011/0139045 | A1* | 6/2011 | Zatti | F23D 14/60 110/188 |
| 2012/0240917 | A1* | 9/2012 | Tolleneer | F23D 14/84 126/116 R |
| 2012/0247444 | A1 | 10/2012 | Sherrow et al. | |
| 2015/0192291 | A1* | 7/2015 | Akbarimonfared | F23D 14/14 126/116 R |
| 2015/0369495 | A1* | 12/2015 | Maricic | F24D 19/1084 126/116 A |
| 2016/0040905 | A1* | 2/2016 | Shellenberger | F24H 9/1881 126/116 R |

(Continued)

*Primary Examiner* — Jorge A Pereiro
*Assistant Examiner* — Logan P Jones
(74) *Attorney, Agent, or Firm* — KED & Associates LLP

(57) ABSTRACT

A gas furnace includes a mixing pipe through which a mixture formed by mixing fuel gas and air flows; a burner assembly that generates combustion gas by burning the mixture that passed through the mixing pipe; and a heat exchanger through which the combustion gas flows. In this case, the burner assembly includes a burner in which flame generated when the mixture is burned is seated; and a mixing chamber that mediates delivery of the mixture from the mixing pipe to the burner, thereby significantly reducing NOx emission.

18 Claims, 10 Drawing Sheets

(56) References Cited

U.S. PATENT DOCUMENTS

| | | | | |
|---|---|---|---|---|
| 2016/0290634 | A1* | 10/2016 | Garloch | F23D 14/46 |
| 2018/0202652 | A1* | 7/2018 | Batson | F23D 14/76 |
| 2020/0173689 | A1* | 6/2020 | Shaw | F23D 14/10 |

* cited by examiner

GAS FURNACE

CROSS-REFERENCE TO RELATED APPLICATION

This application claims the priority benefit of Korean Patent Application No. 10-2019-0070558, filed on Jun. 14, 2019, and Korean Patent Application No. 10-2020-0063579, filed on May 27, 2020, in the Korean Intellectual Property Office, the entire disclosures of all of which are hereby expressly incorporated by reference into the present application.

BACKGROUND OF THE INVENTION

1. Field of the Invention

The present disclosure relates to a gas furnace, and more particularly, to a gas furnace that pre-mixes air and fuel gas before combustion to significantly reduce NOx emissions and to stably propagate flames between individual burners through a flame propagation opening.

2. Description of the Related Art

In general, a gas furnace is an apparatus for heating a room by supplying air, which heat exchanged with high-temperature combustion gas and flame generated during combustion of fuel gas, to the room, and FIG. 1 shows a gas furnace according to the related art.

Referring to FIG. 1, fuel gas and air are burned in a burner assembly 4 to generate flame and high temperature combustion gas. Here, the fuel gas flows into the burner assembly 4 through a manifold 3 from a gas valve (not shown). The high temperature combustion gas may be discharged to the outside through an exhaust pipe 8 after passing through a heat exchanger 5. At this time, the indoor air introduced through a room air duct D1 by a blower 6 may be guided to the room through an air supply duct D2 through the heat exchanger 5, thereby heating the indoor.

Meanwhile, the flow of the combustion gas passing through the heat exchanger 5 and the exhaust pipe 8 is achieved by an inducer 7, and condensate water generated when the combustion gas passes through the heat exchanger 5 and/or exhaust pipe 8 and is condensed may be discharged to the outside through a condensate trap 9.

Thermal NOx (hereinafter, simply referred to as NOx) generated by chemical reaction of nitrogen and oxygen in air at a high temperature (more specifically, a flame temperature of about 1,800 K or more) in the combustion process of fuel gas in a gas furnace is a representative pollutant that causes air pollution, and its emissions are regulated by air quality management organizations.

For example, in North America, the South Coast Air Quality Management District (SCAQMD) regulates NOx emissions, and recently, lowered permitted NOx emissions from 40 ng/J (nano-grams per Joule) to less than 14 ng/J such that the regulation is strengthened.

Accordingly, technology development for reducing NOx emission in the gas furnace has been actively conducted. U.S. Patent Publication No. 20120247444A1 discloses a premix gas furnace that previously mixes air and fuel gas before combustion, and discloses a technology configuration for reducing NOx generation by lowering the flame temperature by increasing the air ratio.

However, there is a problem in that there is a limit in lowering the flame temperature only by adjusting the air ratio, as in the above-mentioned U.S. patent Publication, and the excessive increase of the air ratio may cause flame instability.

Meanwhile, in the case of the above-mentioned U.S. patent Publication, there is a problem in that there is a safety risk because a technology configuration for stably propagating flames between individual burners is not disclosed, excluding a passage through which flames are propagated.

SUMMARY OF THE INVENTION

A first object to be solved by the present disclosure is to provide a gas furnace capable of significantly reducing NOx emissions.

A second problem to be solved by the present disclosure is to provide a gas furnace capable of reducing NOx emission by reducing the flame temperature by increasing the air ratio.

A third problem to be solved by the present disclosure is to provide a gas furnace capable of securing the stability of a flame seated in a burner even if the load of an inducer is increased to increase the air ratio.

A fourth problem to be solved by the present disclosure is to provide a gas furnace capable of stably propagating flames between individual burners.

In order to solve the above problems, a gas furnace according to the present disclosure includes a mixing pipe through which a mixture formed by mixing fuel gas and air flows; a burner assembly that generates combustion gas by burning the mixture that passed through the mixing pipe; and a heat exchanger through which the combustion gas flows.

In this case, the burner assembly includes a burner in which flame generated when the mixture is burned is seated; and a mixing chamber that mediates delivery of the mixture from the mixing pipe to the burner; a burner plate to which the burner is coupled; and a plurality of combustion chambers having one end coupled to the other side of the burner plate, and the other end positioned adjacent to the heat exchanger, wherein the burner plate has a plurality of burner holes communicating with the plurality of combustion chambers, and a flame propagation opening for mediating flame propagation between the burners, thereby significantly reducing NOx emission.

A plurality of heat exchangers have the same number as a plurality of burners.

The mixing chamber is positioned in a front end of the plurality of burners, and guides the mixture passed through the mixing pipe to the plurality of burners and the flame propagation opening.

The burner includes a burner perforated plate in which a plurality of ports through which the mixture passed through the mixing chamber is ejected is formed; and a burner mat which is coupled to an upper side of the burner perforated plate and uniformly disperses the mixture ejected through the port.

In order to solve the above problems, a gas furnace according to the present disclosure includes a mixer that forms a mixture by mixing air and fuel gas introduced from each of an intake pipe and a manifold; a mixing pipe through which the mixture passed through the mixer flows; a burner assembly that generates combustion gas by burning the mixture that passed through the mixing pipe; and a heat exchanger through which the combustion gas flows, wherein the mixer includes a mixer housing having a front end to which the intake pipe is connected, a rear end to which the mixing pipe is connected, and a side surface to which the manifold is connected; and a venturi tube located inside the mixer housing, wherein the burner assembly includes a burner in which flame generated when the mixture is burned is seated; a mixing chamber that mediates delivery of the mixture from the mixing pipe to the burner; a burner plate to which the burner is coupled; and a plurality of combustion chambers having one end coupled to the other side of the burner plate, and the other end positioned adjacent to the heat exchanger, wherein the burner plate has a plurality of burner holes communicating with the plurality of combustion chambers, and a flame propagation opening for mediating flame propagation between the burners.

BRIEF DESCRIPTION OF THE DRAWINGS

The above and other objects, features and advantages of the present disclosure will be more apparent from the following detailed description in conjunction with the accompanying drawings, in which.

DESCRIPTION OF EXEMPLARY EMBODIMENTS

Figure 1:
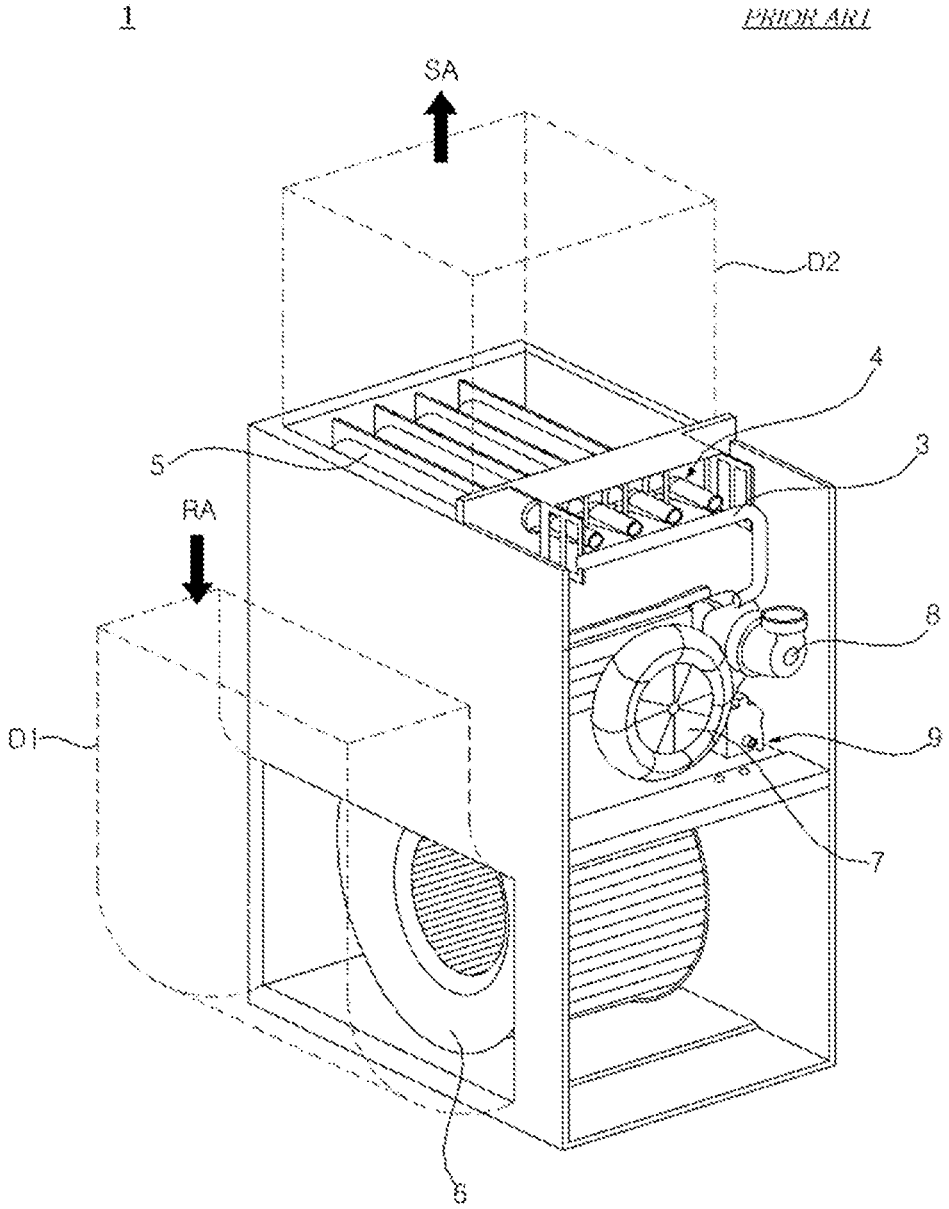
FIG. 1 is a perspective view of a gas furnace according to a related art.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. The present disclosure is defined only by the scope of the claims. Like reference numerals refer to like elements throughout the specification.

Figure 2:
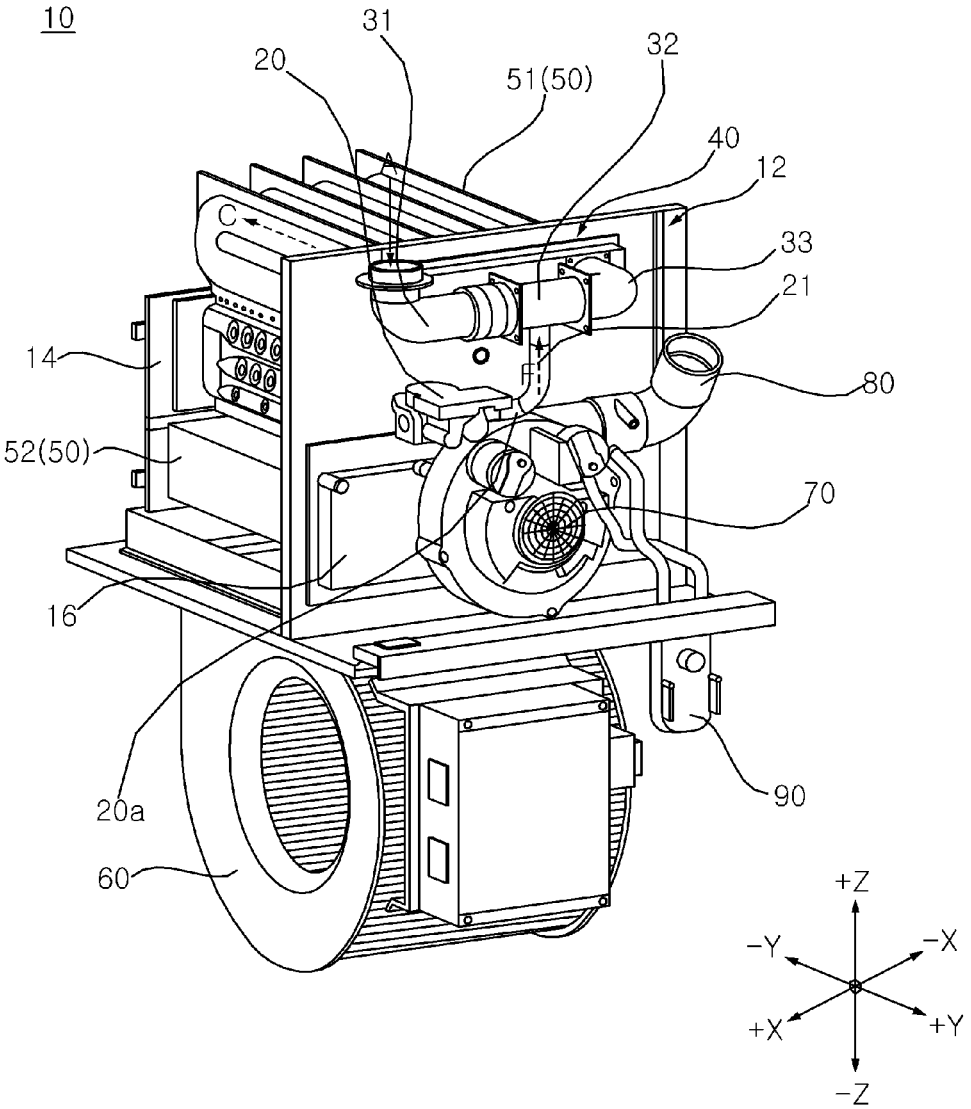
FIG. 2 is a perspective view of a gas furnace according to an embodiment of the present disclosure.

The present disclosure may be described based on a space orthogonal coordinate system by X-axis, Y-axis and Z-axis orthogonal to each other shown in FIG. 2 and the like. In this specification, X-axis, Y-axis, and Z-axis are defined with the vertical direction as the Z-axis direction and the front-rear direction as the X-axis direction. Each axis direction (X-axis direction, Y-axis direction, Z-axis direction) means both directions in which each axis extends. The directions having '+' sign in front of each axis direction (+X axis direction, +Y axis direction, +Z axis direction) mean a positive direction which is one of both directions in which each axis extends. The directions having '−' sign in front of each axis direction (−X-axis direction, −Y-axis direction, −Z-axis direction) mean a negative direction which is the other of both directions in which each axis extends.

Hereinafter, a gas furnace according to an embodiment of the present disclosure will be described in more detail with reference to FIGS. 2 to 10.

FIG. 2 is a perspective view of a gas furnace according to an embodiment of the present disclosure A gas furnace 10 according to an embodiment of the present disclosure is an apparatus for heating a room by supplying air, which heat exchanged with high-temperature combustion gas and flame generated during combustion of fuel gas F, to the room.

Referring to FIG. 2, the gas furnace 10 may include a mixer 32 which mixes air A and fuel gas F and/or exhaust gas E, a mixing pipe 33 through which the mixture gas that passed through the mixer 32 flows, a burner assembly 40 for burning the mixture gas passed through the mixing pipe 33 to generate combustion gas C, and a heat exchanger 50 through which combustion gas C flows.

In addition, the gas furnace 10 includes an inducer 70 causing the flow of combustion gas C that is discharged to an exhaust pipe 80 through the heat exchanger 50, a blower 60 for blowing air supplied to the room around the heat exchanger 50, and a condensate trap 90 for collecting the condensate water generated in the heat exchanger 50 and/or the exhaust pipe 80 and discharging the condensate water to the outside.

The air A flows into the mixer 32 through an intake pipe 31, and the fuel gas F flows into the mixer 32 from a gas valve 20 and a nozzle 20*a* through the manifold 21. Here, for example, a liquefied natural (LNG) gas liquefied by cooling natural gas or a liquefied petroleum (LPG) gas liquefied by pressurizing gas obtained as a by-product of a petroleum refining process can be used as the fuel gas F.

According to the opening and closing of the gas valve 20, the fuel gas F may be supplied to the manifold 21 or may be blocked, and the opening degree of the gas valve 20 may be adjusted to control the amount of the fuel gas F supplied to the manifold 21. As a result, the gas valve 20 may adjust the thermal power of the gas furnace 10.

As described later, a mixture gas of air and fuel gas F may flow through the mixing pipe 33. The mixing pipe 33 may guide the mixture gas to the burner assembly 40 described later, and the mixing of the gas may be continued while the mixture gas is guided to the burner assembly 40 through the mixing pipe 33.

The mixer introduced into the burner assembly 40 may be burned due to ignition of an igniter. In this case, the mixture gas may be burned to generate flame and high temperature combustion gas C.

A flow path through which the combustion gas C can flow may be formed in the heat exchanger 50. Hereinafter, it will be described that the gas furnace 10 includes a heat exchanger 50 composed of a first heat exchanger 51 and a second heat exchanger 52 described later. However, in some embodiment, it is obvious that only the first heat exchanger 51 can be provided.

The first heat exchanger 51 may have one end disposed adjacent to the burner assembly 40. The other end opposite to the one end of the first heat exchanger 51 may be coupled to a hot collect box 14 (HCB). The combustion gas C flowing from one end of the first heat exchanger 51 to the other end may be transmitted to the second heat exchanger 52 through the HCB 14.

One end of the second heat exchanger 52 may be connected to the HCB 14. The combustion gas C that passed through the first heat exchanger 51 may flow into one end of the second heat exchanger 52 and pass through the second heat exchanger 52. The second heat exchanger 52 may heat-exchange the combustion gas C passed through the first heat exchanger 51 with the air passing around the second heat exchanger 52 once again. That is, the thermal energy of the combustion gas C passed through the first heat exchanger 51 can be additionally used through the second heat exchanger 52, thereby improving the efficiency of the gas furnace 10.

The combustion gas C passed through the second heat exchanger 52 is condensed during the heat transfer with air passing around the second heat exchanger 52, thereby generating condensate water. In other words, the water vapor contained in the combustion gas C is condensed to change the state into condensate water. For this reason, the gas furnace 10 having the first heat exchanger 51 and the second heat exchanger 52 is also called a condensing gas furnace. At this time, the generated condensate water may be collected in a cold collect box 16 (CCB). To this end, the other end opposite to the one end of the second heat exchanger 52 may be connected to one side surface of the CCB 16.

The condensate water generated in the second heat exchanger 52 may be discharged to the outside of the gas furnace 10 through a discharge port, after flowing to the condensate trap 90 through the CCB 16. In this case, the condensate trap 90 may be coupled to the other side surface of the CCB 16. In addition, the condensate trap 90 may collect and discharge not only the condensate water generated in the second heat exchanger 52 but also the condensate water generated in the exhaust pipe 80 connected to the inducer 70. That is, the combustion gas C that is not condensed in the other end of the second heat exchanger 52 is collected by the condensate trap 90 together with the condensate water generated when it passes through the exhaust pipe 80 and is condensed, and may be discharged to the outside of the gas furnace 10 through the discharge port.

An inducer 70 described later may be coupled to the other side surface of the CCB 16. Hereinafter, for simplicity, the inducer 70 is described as being coupled to the CCB 16, but the inducer 70 may be coupled to a mounting plate 12 to which the CCB 16 is coupled.

An opening may be formed in the CCB 16. Through an opening formed in the CCB 16, the other end of the second heat exchanger 52 and the inducer 70 may communicate with each other. That is, the combustion gas C passed through the other end of the second heat exchanger 52 may flow to the inducer 70 through the opening formed in the CCB 16, and then may be discharged to the gas furnace 10 through the exhaust pipe 80.

The inducer 70 may communicate with the other end of the second heat exchanger 52 through the opening formed in the CCB 16. One end of the inducer 70 may be coupled to the other side surface of the CCB 16, and the other end of the inducer 70 may be coupled to the exhaust pipe 80. The inducer 70 may cause the flow of combustion gas C that is passed through the first heat exchanger 51, the HCB 14, and the second heat exchanger 52, and discharged to the exhaust pipe 80. In this regard, the inducer 70 may be called an induced draft motor (IDM).

The blower 60 may be positioned under the gas furnace 10. The air supplied to the room may be moved from the lower portion of the gas furnace 10 to the upper portion by the blower 60. In this regard, the blower 60 may be called an Indoor Blower Motor (IBM).

The blower 60 may allow air to pass around the heat exchanger 50. The air passing around the heat exchanger 50 by the blower 60 may receive heat energy from the high temperature combustion gas C through the heat exchanger 50 to increase the temperature. As the air having the increased temperature is supplied to the room, the room can be heated.

The gas furnace 10, similarly to the gas furnace 1 according to the related art shown in FIG. 1, may include a case (no reference numeral). The above-described components of the gas furnace 10 may be accommodated inside the case.

A lower side opening (no reference numeral) may be formed in a side surface adjacent to the blower 60 in the lower portion of the case. A room air duct D1 through which air (hereinafter, room air RA) introduced from the room passes may be installed in the lower side opening. An air supply duct D2 through which air (hereinafter, supplied air SA) supplied to the room passes may be installed in an upper side opening (no reference numeral) formed in the upper portion of the case.

That is, when the blower 60 operates, the air introduced from the room through the room air duct D1 as the room air RA passes through the heat exchanger 50 and has a rising temperature, and may be supplied to the room as a supplied air SA through the air supply duct D2 so that the room can be heated.

In comparison with the gas furnace 10 according to an embodiment of the present disclosure described above and below, the gas furnace 1 according to the related art shown in FIG. 1 has a difference like the following configuration.

That is, the fuel gas passed through the manifold 3 is injected into the burner assembly 4 through a nozzle installed in the manifold 3 in the gas furnace 1 according to the related art, and the fuel gas may be mixed with air that passed through a venturi tube (no reference numeral) of the burner assembly 4 and is naturally sucked to the burner assembly 4 so that a mixture gas can be formed. However, in the case of the gas furnace 1 according to the related art configured as described above, it may be difficult to reduce the NOx emissions for the following reasons.

First, it can be understood that the gas furnace 1 according to the related art constitutes a partial premixing mechanism that exhibits the characteristics of diffusion combustion such that the mixture gas of the fuel gas, which is injected from the nozzle, that is mixed with a first air introduced through a space between the lower side of the burner assembly 4 and the nozzle while passing through the venturi tube is burned together with a second air introduced through a space between the upper side of the burner assembly 4 and the heat exchanger 5.

However, in the case of a gas furnace constituting such a partial premixing mechanism, due to the characteristics of diffusion combustion in which the diffusion rate of the flame is considerably slower than the combustion chemical reaction rate, it may be difficult to lower the flame temperature even if the second air is controlled to be excessively supplied. Furthermore, it is difficult to control the air ratio (i.e.

the ratio of the actual air amount to the theoretical air amount), and thus there is a limit in reducing NOx emissions.

In order to solve such a problem, the present disclosure is devised to provide a gas furnace that configures a full premixing mechanism and further provides an individual burner to reduce heat loss, while ensuring flame stability in each burner to have a wide range of fire power and achieving a stable flame propagation between individual burners, and will be described later in more detail.

Figure 3:
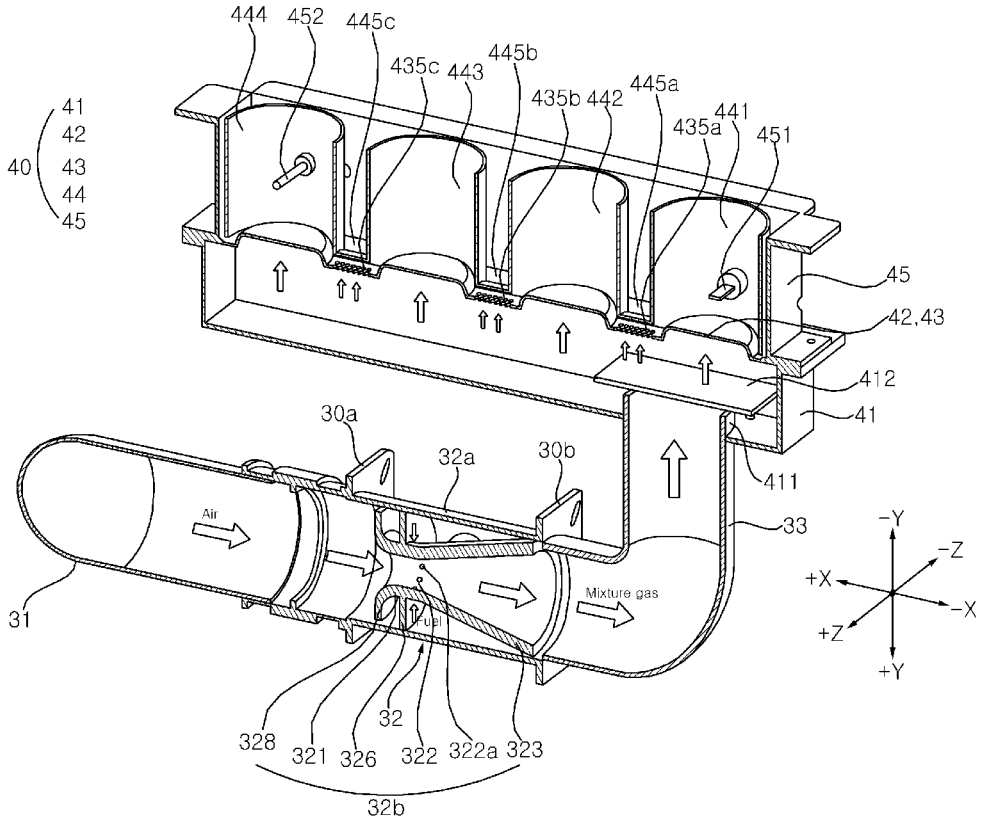
FIG. 3 is a cross-sectional view of a partial configuration of a gas furnace according to an embodiment of the present disclosure.

FIG. 3 is a cross-sectional view of a partial configuration of a gas furnace according to an embodiment of the present disclosure.

Referring to FIGS. 2 and 3, the gas furnace 10 includes a mixer 32, a mixing pipe 33, a burner assembly 40, a heat exchanger 50, an exhaust pipe 80, an inducer 70, and a blower 60.

The inducer 70 causes a flow through which the air A is sucked into the mixer 32 through the intake pipe 31, and causes a flow of the mixture gas described later from the mixing pipe 33 to the burner assembly 40, and causes a flow of combustion gas C described later from the burner assembly 40 to the heat exchanger 50 and the exhaust pipe 80. Meanwhile, the blower 60 may cause the flow of air passing around the heat exchanger 50.

The mixer 32 mixes air A and fuel gas F introduced respectively from the intake pipe 31 and the manifold 21 to form a mixer. Here, the intake pipe 31 is a pipe having one side which is exposed to the outside and through which air for participating in the combustion reaction is sucked, the manifold 21 pipe having one side which is connected to the gas valve 20 and through which the fuel gas F for participating in the combustion reaction flows, and as described above, the amount of the fuel gas F flowing through the manifold 21 can be adjusted according to whether the gas valve 20 is opened or closed or according to the degree of opening. In addition, the gas furnace 10 may further include a controller that controls the opening or closing of the gas valve 20 or controls the degree of opening.

The mixture gas formed in the mixer 32 may be supplied to the burner assembly 40 via the mixing pipe 33. Since air A participating in the combustion reaction is supplied to the burner assembly 40 in a state of being fully premixed with the fuel gas F, it may be easy to lower the flame temperature through air ratio adjusting (i.e. adjusting the amount of air that is sucked in so that air is excessively supplied to the combustion reaction).

In addition, since the intake pipe 31, the mixer 32, the mixing pipe 33, the burner assembly 40, and the heat exchanger 50 communicate with each other, the NOx emission can be greatly reduced by lowering the flame temperature by easily adjusting the air ratio through the operation of the inducer 70. In other words, it is possible to easily achieve the combustion conditions in the lean area for NOx emission reduction.

In the present disclosure, as described above and below, a venturi effect is used to increase the mixing ratio of air A and fuel gas F in the mixer 32, and more detailed description will be given later.

The mixer 32 may include a mixer housing 32*a* and a venturi tube 32*b*. The mixer housing 32*a* may have a front end connected to the intake pipe 31, a rear end connected to the mixing pipe 33, and a side surface connected to the manifold 21. Here, the intake pipe 31 is connected to the mixer housing 32*a* via an intake pipe connection portion 31*a*, and the mixing pipe 33 may be integrally connected to the rear end of the mixer housing 32*a*, but the present disclosure is not limited thereto.

That is, the air A and the fuel gas F may flow into the inside of the mixer 32 through each of the intake pipe 31 and the manifold 21 and are mixed with each other and then supplied to the mixing pipe 33.

The venturi tube 32*b* may be positioned inside the mixer housing 32*a*. The outer circumferential surfaces of each of a converging section 321, a throat 322, and a diverging section 323, which will be described later, of the venturi tube 32*b* may be spaced apart by a certain distance from the inner circumferential surface of the mixer housing 32*a*.

However, the venturi tube 32*b* is formed to extend outward from the outer circumferential surface and includes a flange 326 that is in close contact with the inner circumferential surface of the mixer housing 32*a*, so that the venturi tube 32*b* is fixed inside the mixer housing 32*a*.

The venturi tube 32*b* may include a converging section 321, a throat 322, and a diverging section 323.

The converging section 321 may have one end in which an inlet through which air A passed through the intake pipe 31 is introduced is formed, and a flange 328 may be formed in the outer circumferential surface of the one end. A pressure sensor is installed in the flange 328 to detect the pressure of air flowing into the venturi tube 32*b*.

The converging section 321 may be formed to decrease in diameter as it progresses in the downstream direction. Thus, as known as the venturi effect, the pressure of the air passing through the converging section 321 may drop (also, increase the flow rate), and negative pressure may be formed. At this time, due to the pressure drop of the air, the inflow of the fuel gas F through a fuel inflow hole 322*a* of the throat 322 described later may be facilitated. In addition, the turbulence intensity of the air is increased due to the increase in the flow rate of the air, and thus the mixing ratio between the air A and the fuel gas F described later may be increased.

The throat 322 is connected to the converging section 321, and a fuel inflow hole 322*a* through which the fuel gas F passed through the manifold 21 is introduced may be formed in at least a portion of the side surface of the throat 322.

The fuel inflow hole 322*a* may include a plurality of fuel inflow holes 322*a* spaced apart from each other by a certain distance in a circumferential direction of the throat 322 such that the fuel gas F can be smoothly introduced into the inside of the venturi tube 32*b*.

The diverging section 323 is connected to the throat 322, and the air A and the fuel gas F passed through each of the converging section 321 and the fuel inflow hole 322*a* may be mixed to form a mixture and flow.

The diverging section 323 may be formed to increase in diameter as it progresses in the downstream direction. Thus, the pressure that is lowered while passing through the converging section 321 may be recovered by a certain value while passing through the diverging section 323, and mixing of air A and fuel gas F may be easier. In addition, the diverging section 323 may have one end in which a discharge portion for discharging the mixture to the mixing pipe 33 is formed.

Meanwhile, the venturi tube 32*b* may include a flange 326 that extends outward from the outer circumferential surface of a portion connected to the throat 322 of the converging section 321 and is in close contact with the inner circumferential surface of the mixer housing 32*a*. The flange 326 not only fixes the venturi tube 32*b* to the inside of the mixer housing 32*a*, but also blocks the fuel gas F passed through the manifold 21 from flowing to the outside of the converging section 321.

The manifold 21 may be connected to the outer circumferential surface of a portion corresponding to between the flange 326 of the mixer housing 32*a* and the rear end of the mixer housing 32*a*. In this case, a hole communicating with the manifold 21 may be formed in the mixer housing 32*a*.

Meanwhile, a mixture that passed through the mixer 32 may flow through the mixing pipe 33. The mixing pipe 33 may guide the mixture to the burner assembly 40. The burner assembly 40 may burn the mixture that passed through the mixing pipe 33 to generate flame and high temperature combustion gas C.

A gas flow path through which the high-temperature combustion gas C generated according to the combustion reaction flows may be formed in the heat exchanger 50. The combustion gas (hereinafter, referred to as exhaust gas E) that passed through the heat exchanger 50 may be discharged to the outside through the exhaust pipe 80 via the inducer 70, as described above. At this time, as described above, the condensate water generated by condensation in the heat exchanger 50, particularly, in the second heat exchanger 52 and the exhaust pipe 80, is collected in the condensate trap 90 and may be discharged to the outside.

Figure 4:
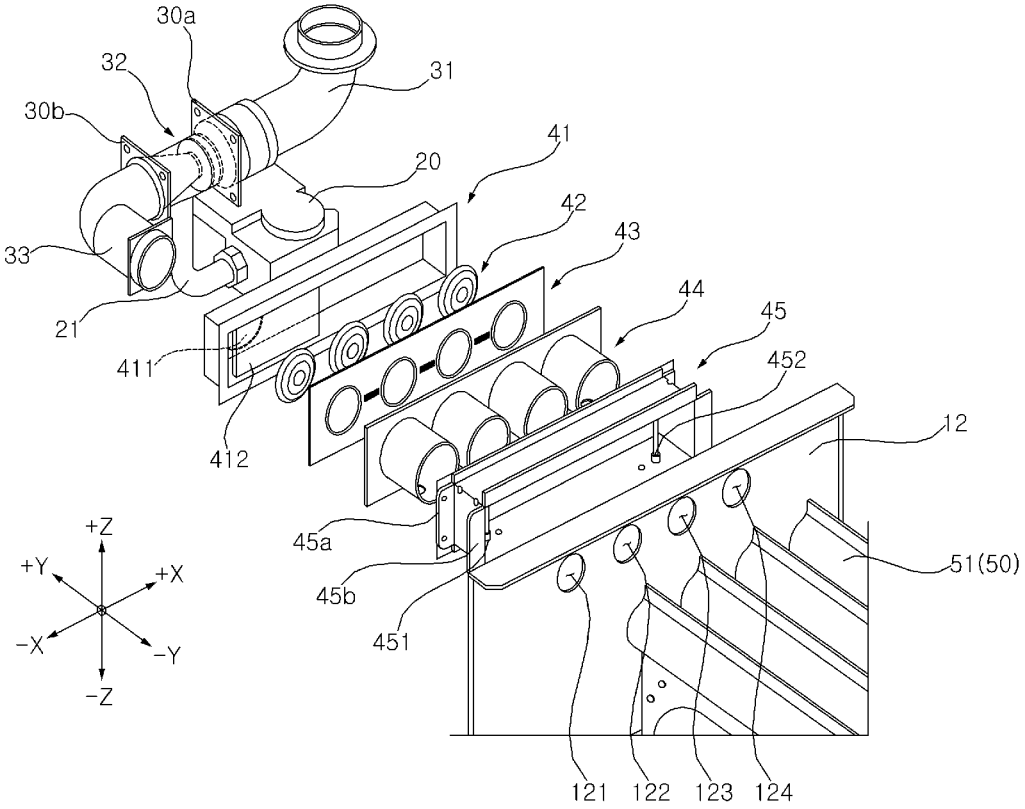
FIG. 4 is an exploded perspective view of a partial configuration of a gas furnace according to an embodiment of the present disclosure.
Figure 5:
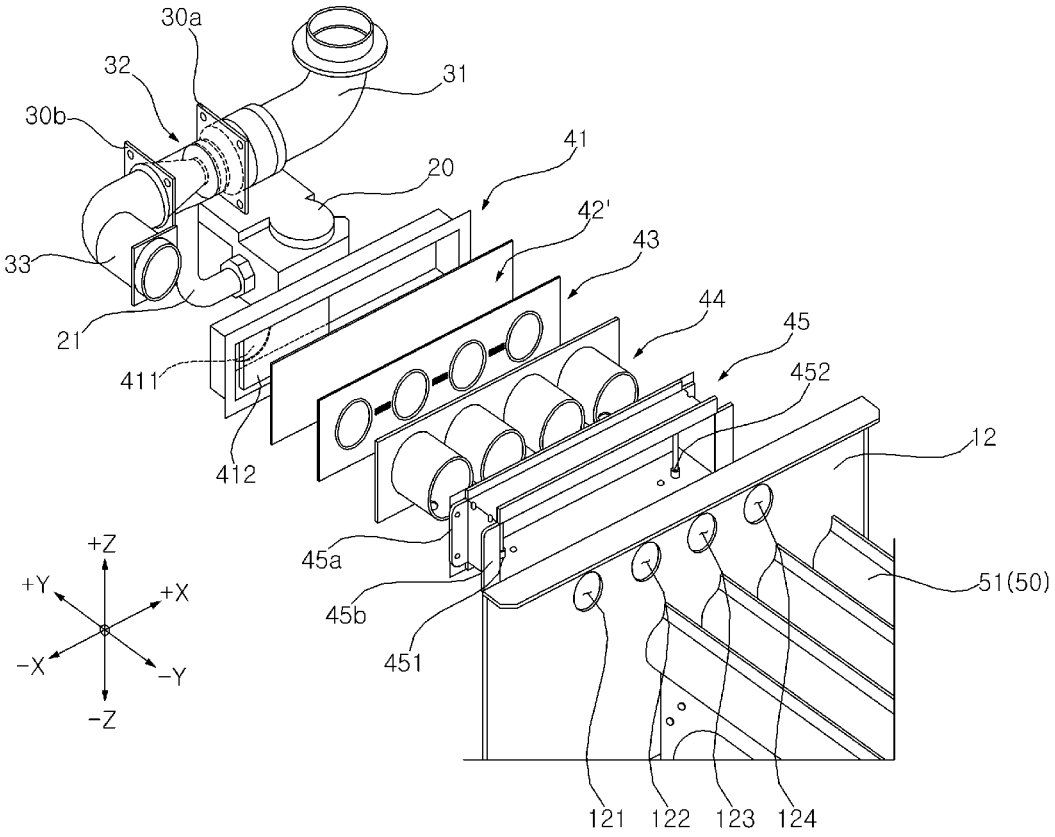
FIG. 5 is an exploded perspective view of a partial configuration of a gas furnace according to another embodiment of the present disclosure.

FIG. 4 is an exploded perspective view of a partial configuration of a gas furnace according to an embodiment of the present disclosure, and FIG. 5 is an exploded perspective view of a partial configuration of a gas furnace according to another embodiment of the present disclosure.

Referring to FIGS. 3 and 4, the burner assembly 40 may include a mixing chamber 41, a burner 42, a burner plate 43, a combustion chamber 44, and a burner box 45. The gas furnace 10 may include a plurality of first heat exchangers 51. In this case, the gas furnace 10 may include a plurality of burners 42 and combustion chambers 44 equal to the number of first heat exchangers 51. For example, in the gas furnace 10, four first heat exchangers 51 are disposed side by side, and correspondingly, four burners 42 and four combustion chambers 44 may be provided.

The mixing chamber 41 may mediate the delivery of the mixture from the mixing pipe 33 to the burner 42. That is, the mixing pipe 33 is connected to a connector 411 formed in one side of the mixing chamber 41, and the mixture passed through the mixing pipe 33 flows to the inside of the mixing chamber 41 through the connector 411, and then may be supplied to the burner 42. Mixing of the gas may be continued while the mixture is guided to the burner 42 through the mixing chamber 41.

During movement of the mixture from the mixing pipe 33 to the mixing chamber 41, at least a part of the upper end of the mixing pipe 33 may be inserted into the mixing chamber 41 via the connector 411 to prevent the mixture from leaking.

A uniform guide 412 is installed inside the mixing chamber 41 so that the mixture passed through the mixing pipe 33 is uniformly distributed to each of the plurality of burners 42. In particular, the uniform guide 412 may allow the mixture to be uniformly distributed to each of the plurality of burners 42, even if the connector 411 is formed in a distal end of any one direction of the horizontal direction of the mixing chamber 41. For example, the uniform guide 412 may be positioned to face the connector 411 and may be formed of a rectangular plate.

The uniform guide 412 may be installed in a flow path of the mixture extended from the mixing pipe 33 to the plurality of burners 42 to form a certain pressure load so that a uniform flow field to each burner of the mixer may be formed. Accordingly, the uniform guide 412 can prevent the NOx from being generated by increasing the flame temperature as the mixture is intensively supplied to any one of the plurality of burners 42.

A flame generated when the mixer is burned may be seated in the burner 42. In the gas furnace 10 according to the embodiment of the present disclosure shown in FIG. 4, the burner 42 may include a plurality of burners 42 which are formed in a disk shape respectively. In the gas furnace 10 according to another embodiment of the present disclosure shown in FIG. 5, the burner 42' may include a single burner 42' formed in a rectangle corresponding to the shape of the burner plate 43.

That is, since the burner 42, 42' is coupled to one side of the burner plate 43, and the shape and number of a portion of the burner 42, 42' exposed to the combustion chamber 44 are determined by the shape and number of burner hole formed in the burner plate 43, the shape and number of burner 42, 42' in the present disclosure can be applied in various ways. In addition, it can be expected that the burner 42 is protected from external impact by the burner plate 43. In addition, as described below, a flame propagation opening is formed in the burner plate 43, so that it is possible to mediate flame propagation between the burners 42.

The burner plate 43 may have one side to which a plurality of burners 42 are coupled. A plurality of burner holes communicating with the plurality of combustion chambers 44 may be formed in a body 430 of the burner plate 43. For example, when the gas furnace 10 is provided with first to fourth burners 421, 422, 423, and 424, and first to fourth combustion chambers 441, 442, 443, and 444, first to fourth burner holes 431, 432, 433, and 434 communicating with each of the first to fourth combustion chambers 441, 442, 443, and 444 may be formed in the body 430 of the burner plate 43.

The combustion chamber 44 may have one end coupled to the other side of the burner plate 43, and the other end positioned adjacent to the plurality of first heat exchangers 51. For example, when four first heat exchangers 51 are provided in the gas furnace 10, the combustion chamber 44 may include first to fourth combustion chambers 441, 442, 443, and 444.

The mixing chamber 41 is coupled to one end of the burner box 45, and one side of the mounting plate 12 can be coupled to the other end. In addition, the burner 42, the burner plate 43, and the combustion chamber 44 may be positioned inside a burner box 45.

A plurality of holes 121, 122, 123, and 124 are formed in the mounting plate 12, and the plurality of heat exchangers 51 coupled to the other side of the mounting plate 12 may communicate with the combustion chamber 44 positioned inside the burner box 45 through a plurality of holes 121, 122, 123, and 124. Accordingly, the flame and high temperature combustion gas C passing through the combustion chamber 44 may be supplied to the inside of the heat exchanger 51.

That is, the flame and the high-temperature combustion gas C generated in each of the plurality of burners 42 are guided to each of the plurality of heat exchangers 51 via each of the plurality of combustion chambers 44, thereby reducing heat loss in comparison with the case where the burner facing the plurality of heat exchangers is formed in an integrated type (i.e. the case where part of the flame and high-temperature combustion gas C generated in the integrated type burner escape to between a plurality of heat exchangers to generate heat loss).

Figure 6:
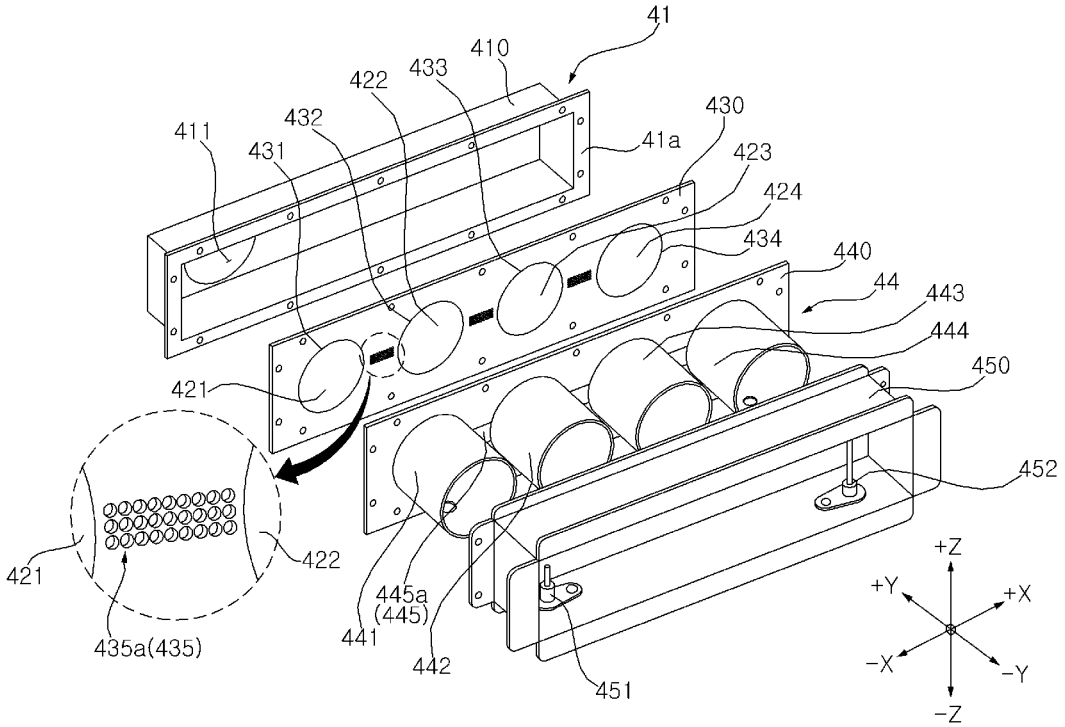
FIG. 6 is an exploded perspective view of a burner assembly of a gas furnace according to an embodiment of the present disclosure.
Figure 7:
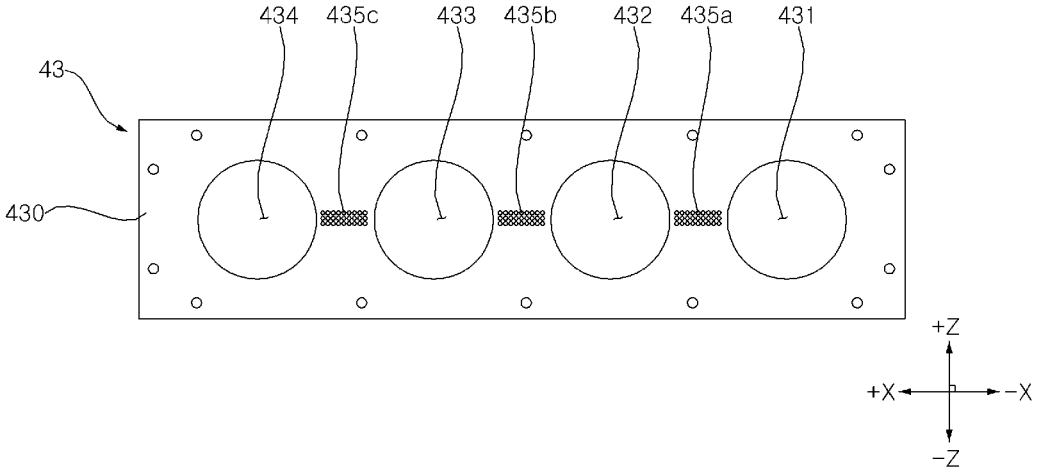
FIG. 7 is a plan view of a burner plate of a gas furnace according to an embodiment of the present disclosure.

FIG. 6 is an exploded perspective view of a burner assembly of a gas furnace according to an embodiment of the present disclosure, FIG. 7 is a plan view of a burner plate of a gas furnace according to an embodiment of the present disclosure, and FIG. 8 is a view showing the shape and arrangement of a flame propagation opening of a gas furnace according to first to third embodiments of the present disclosure.

Unlike FIG. 4, in FIG. 6, a plurality of burners 42 (421, 422, 423, 424) are coupled to the body 430 of the burner plate 43. Referring to FIGS. 4 and 6, when the burner closest to the connector 411 of the mixing chamber 41 among the four burners 42 shown in the drawing is referred to as a first burner 421, the second, third, and fourth burners 422, 423, and 424 may be disposed to be spaced apart from each other by a certain distance in the +X axis direction from the first burner 421.

In addition, among the four combustion chambers 44 shown in the drawing, when the combustion chamber, which faces the first burner 421 or is adjacent to the first burner 421, that is closest to the connector 411 is referred to as a first combustion chamber 441, the second, third, and fourth combustion chambers 442, 443, and 444 may be positioned to be spaced apart from each other by a certain distance in the +X axis direction from the first combustion chamber 441.

In this case, the gas furnace 10 may further include an igniter 451 positioned inside the first combustion chamber 441. For example, the igniter 451 may be installed in the inner surface of the body 450 of the burner box 45 and inserted into a hole formed in the first combustion chamber 441.

Due to the ignition of the igniter 451, when the mixture supplied to the first burner 421 via the connector 411 is burned, a flame and high temperature combustion gas C may be generated, and the flame generated at this time may be seated in the first burner 421.

When the igniter 451 is positioned only inside the first combustion chamber 441, it is necessary for the flame seated in the burner 421 to propagate to the second to fourth burners 422, 423, and 424 so that the mixture supplied to each of the second to fourth burners 422, 423, and 424 via the connector 411 may be burned.

To this end, a flame propagation opening 435 that is positioned between a plurality of adjacent burner holes 431, 432, 433, and 434, and mediates flame propagation between the plurality of burners 42 may be formed in the burner plate 43. In this case, the burner assembly 40 may include a flame propagation tunnel 445 (445*a*, 445*b*, 445*c*) that is formed between a plurality of adjacent combustion chambers 44, as a position corresponding to the position where the flame propagation opening 435 is formed, and forms a flame propagation passage between the flame propagation opening 435 and the flame propagation tunnel 445.

The flame propagation tunnel 445 prevents the mixture ejected from the flame propagation opening 435 from leaking to the outside, so that the flame propagation opening 435 serves only as a configuration for flame propagation between individual burners.

As described below, when the first to third flame propagation openings 435*a*, 435*b*, and 435*c* are formed in the burner plate 43, the flame propagation tunnel 445 may include first to third flame propagation tunnels 445*a*, 445*b*, and 445*c*.

The first flame propagation tunnel 445*a* is formed between the first combustion chamber 441 and the second combustion chamber 442 to form a first flame propagation passage between the first flame propagation opening 435*a* and the first flame propagation tunnel 445*a*. The second flame propagation tunnel 445*b* is formed between the second combustion chamber 442 and the third combustion chamber 443 to form a second flame propagation passage between the second flame propagation opening 435*b* and the second flame propagation tunnel 445*b*. The third flame propagation tunnel 445*c* is formed between the third combustion chamber 443 and the fourth combustion chamber 444 to form a third flame propagation passage between the third flame propagation opening 435*c* and the third flame propagation tunnel 445*c*.

The mixture passed through the mixing pipe 33 may be distributed to the flame propagation opening 435 as well as the plurality of burners 42 through the mixing chamber 41, and flame may be propagated between adjacent burners 42 through the flame propagation passage formed between the flame propagation opening 435 and the flame propagation tunnel.

That is, according to a mechanism of generating a flame by burning a mixture ejected from the flame propagation opening 435 by a flame seated in any one of the burners 42 adjacent to the flame propagation opening 435, and of generating a flame, by the flame generated at this time, by burning a mixture ejected from the other of the burners 42 adjacent to the flame propagation opening 435, the flame can propagate between the individual burners through the flame propagation opening 435.

Referring to FIG. 7, the flame propagation openings 435 (435*a*, 435*b*, 435*c*) may be formed by arranging a plurality of holes consecutively. Thus, in comparison with to the case where a single hole is formed in the flame propagation opening 435, the mixture can be ejected uniformly from the flame propagation opening 435 regardless of the distance from the adjacent burner, so that the flame propagation can be more stably achieved.

When the first to fourth burner holes 431, 432, 433, 434 are formed in the burner plate 43, the flame propagation opening 435 may include the first to third flame propagation openings 435*a*, 435*b*, and 435*c*.

The first flame propagation opening 435*a* is formed between a first burner hole 431 exposing the first burner 421 toward the first combustion chamber 441, and a second burner hole 432 exposing the second burner 422 toward the second combustion chamber 442, thereby propagating the flame seated in the first burner 421 to the second burner 422.

The second flame propagation opening 435*b* is formed between the second burner hole 432 and the third burner hole 433 exposing the third burner 423 toward the third combustion chamber 443, so that the flame seated in the second burner 422 can be propagated to the third burner 423.

The third flame propagation opening 435*c* is formed between the third burner hole 433 and the fourth burner hole 434 exposing the fourth burner 424 toward the fourth combustion chamber 444, so that the flame seated in the third burner 423 can be propagated to the fourth burner 424.

Meanwhile, the present disclosure proposes an embodiment of the diameter and arrangement of a plurality of holes forming the flame propagation opening 435 as follows.

Figure 8A:
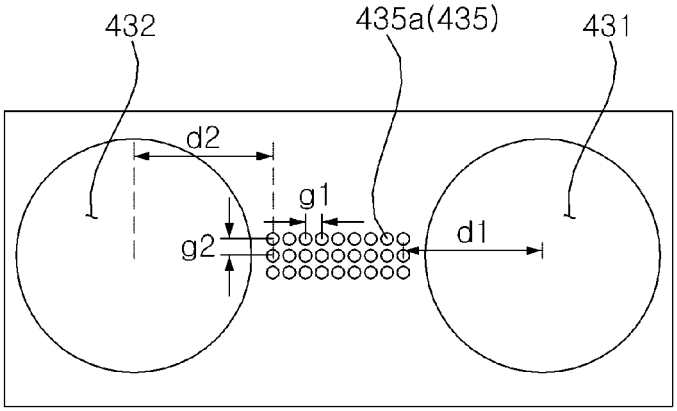
FIGS. 8A-8C are views showing the shape and arrangement of a flame propagation opening of a gas furnace according to first to third embodiments of the present disclosure.

Referring to FIG. 8A, a plurality of holes forming the flame propagation opening 435 according to the first embodiment may be formed to have the same diameter with each other, and arranged side by side with each other.

Figure 8B:
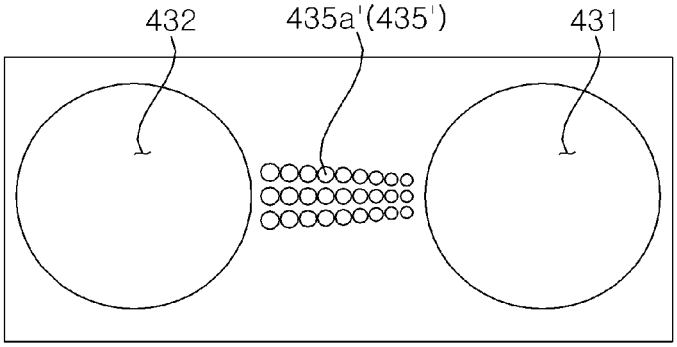

Referring to FIG. 8B, a plurality of holes forming the flame propagation opening 435' according to the second embodiment may be formed to be arranged side by side with each other, so that the diameter increases as the distance to the connector 411 increases. That is, considering that the amount of the mixture supplied is reduced as the distance from the connector 411 increases, the diameter of the hole is designed to be large, so that the mixture can be uniformly supplied to the flame propagation opening 435 regardless of the distance to the connector 411.

Figure 8C:
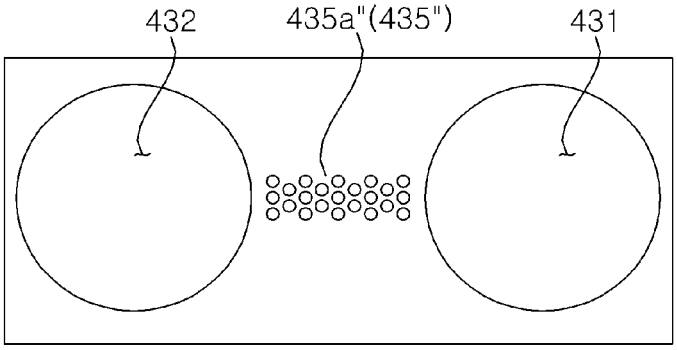

Referring to FIG. 8C, a plurality of holes forming the flame propagation opening 435" according to the third embodiment have the same diameter, but may be formed to cross each other. Thereby, it can be expected that the mixture is ejected more uniformly from the flame propagation opening 435.

Figure 9:
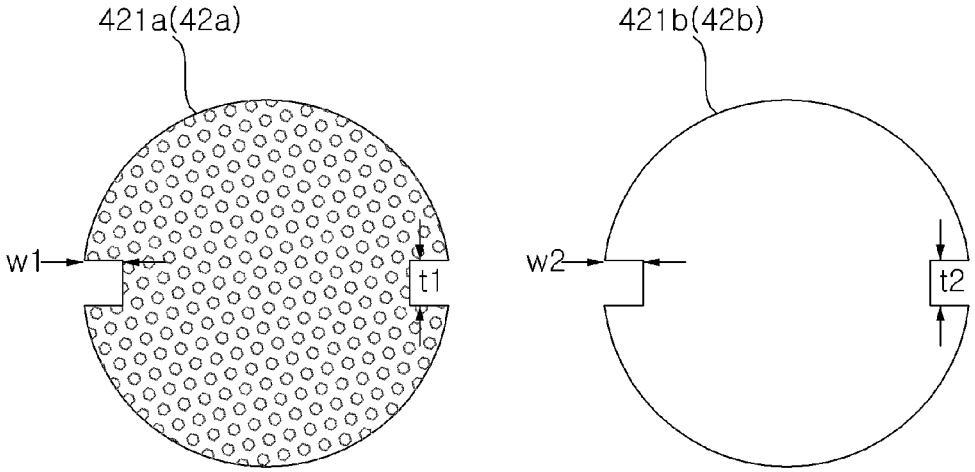
FIG. 9 is a plan view of a burner perforated plate and a burner mat constituting a burner of a gas furnace according to an embodiment of the present disclosure.
Figure 10:
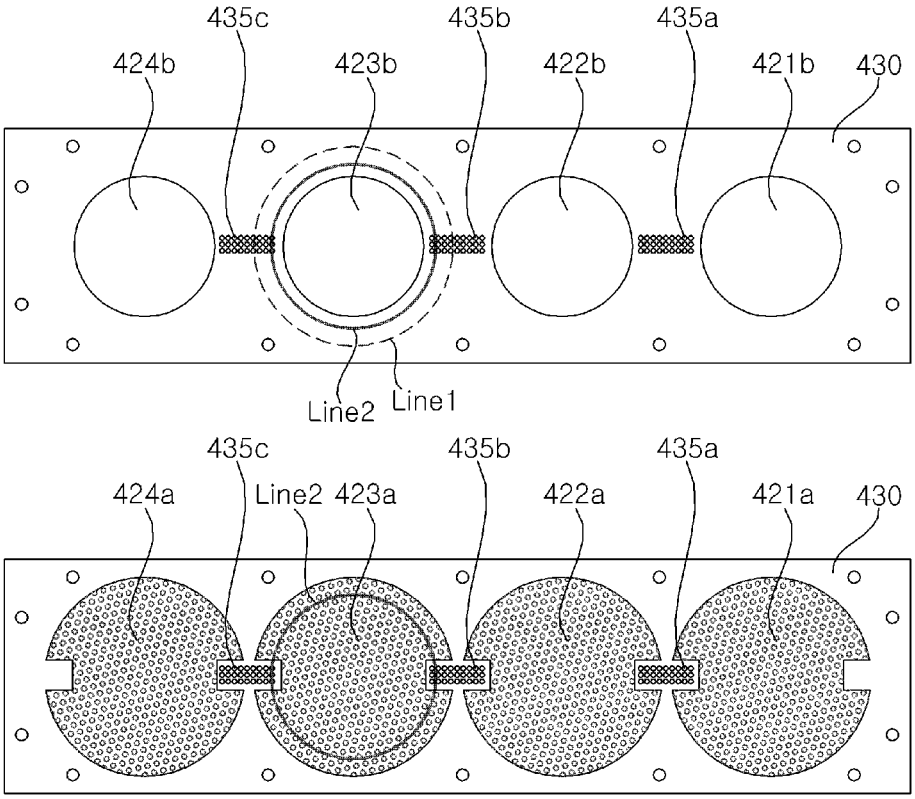
FIG. 10 is a view showing a state in which a burner of a gas furnace according to an embodiment of the present disclosure is installed in a burner plate.

FIG. 9 is a plan view of a burner perforated plate and a burner mat constituting a burner of a gas furnace according to an embodiment of the present disclosure, and FIG. 10 is a view showing a state in which a burner of a gas furnace according to an embodiment of the present disclosure is installed in a burner plate.

Referring to FIGS. 9 and 10, the burner 42 in which the flame generated during combustion of the mixture is seated may include a burner perforated plate 42*a* and a burner mat 42*b*.

That is, the first burner 421 may include a first burner perforated plate 421*a* and a first burner mat 421*b*, a second burner 422 may include a second burner perforated plate 422*a* and a second burner mat 422*b*, a third burner 423 may include a third burner perforated plate 423*a* and a third burner mat 423*b*, and a fourth burner 424 may include a fourth burner perforated plate 424*a* and a fourth burner mat 424*b*.

The burner perforated plate 42*a* may have a plurality of ports through which the mixture is ejected. For example, the burner perforated plate 42*a* may be formed of a stainless material. The burner perforated plate 42*a* may serve to uniformly distribute the mixer to the burner mat 42*b* described later, and in this case, the flow of the mixture is redistributed between the burner perforated plate 42*a* and the burner mat 42*b* so that it can help to form a more uniform flow of the mixture. Further, in comparison with the case where the burner 42 is provided with only the burner mat 42*b* in some embodiments, flame stability can be improved in the case where the burner 42 is provided with the burner perforated plate 42*a* configured as described above as well as the burner mat 42*b*. Furthermore, the burner perforated plate 42*a* may also serve to support the burner mat 42*b*.

The burner mat 42*b* may be coupled to the upper side of the burner perforated plate 42*a*, and can more uniformly disperse the mixture ejected through the port of the burner perforated plate 42*a*. Thus, flame can be more stably seated in the burner mat 42*b*.

The burner mat 42*b* may be formed of a metal fiber material having a gap smaller than the diameter of the port. The burner mat 42*b* configured as described above can be understood as a collection of circular cylinders in which the speed at which the mixture is ejected is close to '0', and thus, a flame can be stably seated in the surface of the burner mat 42*b*. As a result, the flame stability becomes excellent. Accordingly, it may be advantageous in adjusting the thermal power of the gas furnace in a wide range. That is, the burner mat 42*b* configured as described above may be advantageous in preventing a flash back of the flame when the thermal power of the gas furnace is significantly lowered, and preventing the blow out of the flame when the thermal power of the gas furnace is significantly increased.

Each of the burner perforated plate 42*a* and the burner mat 42*b* may be formed convex or concave, or flat. In particular, when each of the burner perforated plate 42*a* and the burner mat 42*b* is formed flat, the flame can be more stably seated in the burner.

Each of the burner perforated plate 42*a* and the burner mat 42*b* may form a concave portion as a part of the side surface of each of the burner perforated plate 42*a* and the burner mat 42*b* is bent toward the inside so as to surround at least a portion of the adjacent flame propagation opening 435.

For example, the degree d1 of bending inwardly of the concave portion formed in the burner perforated plate 42*a* and the degree d2 of bending inwardly of the concave portion formed in the burner mat 42*b* may be the same. In addition, the width w1 of the concave portion formed in the burner perforated plate 42*a* and the width w2 of the concave portion formed in the burner mat 42*b* may be the same.

When the concave portion surrounds at least a portion of the flame propagation opening 435 as in the present disclosure, the burner perforated plate 42*a* and the burner mat 42*b* may be disposed closer to the flame propagation opening 435 so that it may be easy to reduce defects of the flame propagation.

The burner perforated plate 42*a* and the burner mat 42*b* configured as described above may be formed to have the same diameter as Line 1 in FIG. 10. The burner perforated plate 42*a* and the burner mat 42*b* may be welded (spot welding) near Line 2 of FIG. 10 to be coupled to the bottom surface of the body 430 of the burner plate 43. However, this is only exemplary, and the burner perforated plate 42*a* and the burner mat 42*b* may be coupled to the body 430 by other means such as screw fastening.

Meanwhile, due to the presence of foreign matter in the flame propagation hole 435, if the flame does not propagate to at least one of the second to fourth burners 422, 423, and 424, and the above combustion reaction does not occur, the mixture is filled inside the heat exchanger 50, which may cause a safety hazard.

Accordingly, a flame detector 452 is installed in the combustion chamber 44 to detect whether a flame is occurred according to the above-described combustion reaction, and if the flame is not detected even though the mixture is supplied to the mixing chamber 41 and the combustion chamber 44, the gas valve 20 must be closed to block the flow of fuel gas F into the manifold 21.

To this end, the gas furnace 10 according to the embodiment of the present disclosure may further include a flame detector 452 that is positioned in the inner side of the fourth combustion chamber 444, which is a combustion chamber disposed in a position farthest from the first combustion chamber 441 in which the igniter 451 is installed, among the plurality of combustion chambers, and detects whether the flame is generated. For example, the flame detector 452 is installed in the inner surface of the body 450 of the burner box 45, and may be inserted into a hole formed in the fourth combustion chamber 444.

Due to the characteristics that the flame is sequentially propagated through the flame propagation opening 435 of the present disclosure, when the flame detector 452 installed in the fourth combustion chamber 444 detects the flame, it can be considered that a flame is generated according to the above-described combustion reaction in all of the first to fourth combustion chambers 441, 442, 443, 444.

On the other hand, if the flame detector 452 installed in the fourth combustion chamber 444 does not detect the flame, there exists a safety risk because at least the fourth combustion chamber 444 does not generate a flame according to the above-described combustion reaction. Hence, the supply of the fuel gas F should be blocked.

According to the present disclosure, there are one or more of the following effects.

First, by completely premixing air and fuel gas before combustion in the burner assembly, it is possible to easily control the amount of air intake for lean area operation, and as a result, NOx emission can be easily reduced.

Second, since the combustion gas of flame and high temperature is generated in each of the individual burners and guided to each of the plurality of heat exchangers, heat loss can be reduced in comparison with the case where the burner facing the plurality of heat exchangers is formed in an integral type.

Third, flame propagation between individual burners is achieved through flame propagation opening formed by arranging a plurality of holes consecutively, so that flame propagation can be stably achieved.

Fourth, since the burner in which the flame is seated is formed of a metal fiber material having a small gap, it has excellent flame stability. Accordingly, it is advantageous (i.e. excellent top down ratio (TDR)) in controlling the thermal power of gas furnace in a wide range.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas furnace, comprising:

a mixing pipe through which a mixture of fuel gas and air flows;

a burner assembly that burns the mixture that passed through the mixing pipe; and a plurality of heat exchangers through which a combustion gas generated in the burner assembly flows, wherein the burner assembly comprises:

a plurality of burners in which flame generated when the mixture is burned is seated;

a mixing chamber that provides the mixture from the mixing pipe to the plurality of burners;

a burner plate which is opposite to the mixing chamber with respect to the plurality of burners, and to which the plurality of burners are coupled; and a plurality of combustion chambers positioned between the burner plate and the plurality of heat exchangers, and configured to communicate with the plurality of heat exchangers, wherein the burner plate has a plurality of burner holes positioned between the plurality of burners and the plurality of combustion chambers, and a flame propagation opening positioned between the plurality of burner holes, wherein a portion of each of the plurality of burners surrounds at least a portion of the flame propagation opening.

2. The gas furnace of claim 1, wherein the number of the plurality of heat exchangers is equal to the number of the plurality of burners.

3. The gas furnace of claim 1, wherein the mixing chamber is positioned in a front end of the plurality of burners, and guides the mixture passed through the mixing pipe to the plurality of burners and the flame propagation opening.

4. The gas furnace of claim 3, wherein the burner assembly further comprises a flame propagation tunnel that is formed between the plurality of adjacent combustion chambers, as a position corresponding to a position where the flame propagation opening is formed, and forms a flame propagation passage between the flame propagation opening and the flame propagation tunnel.

5. The gas furnace of claim 1, wherein the flame propagation opening is formed by arranging a plurality of holes consecutively.

6. The gas furnace of claim 5, wherein the plurality of holes forming the flame propagation opening have a same diameter, and are formed to be arranged side by side with each other.

7. The gas furnace of claim 5, further comprising a connector formed at one side of the mixing chamber, and the connector to connect to the mixing pipe, wherein the plurality of holes forming the flame propagation opening is arranged side by side, and formed to have a diameter that becomes larger as a distance from the connector increases.

8. The gas furnace of claim 5, wherein the plurality of holes forming the flame propagation opening have a same diameter, and are arranged to cross each other.

9. The gas furnace of claim 1, wherein the burner comprises:

a burner perforated plate in which a plurality of ports through which the mixture passed through the mixing chamber is ejected is formed; and a burner mat which is coupled to an upper side of the burner perforated plate and uniformly disperses the mixture ejected through the port.

10. The gas furnace of claim 9, wherein the burner mat is formed of a metal fiber material having a gap smaller than a diameter of the port.

11. The gas furnace of claim 9, wherein each of the burner perforated plate and the burner mat forms a concave portion as a part of a side surface is bent toward an inside so as to surround at least a portion of adjacent flame propagation opening.

12. The gas furnace of claim 11, wherein each of the burner perforated plate and the burner mat has a shape, which constitutes a part of a circle, that is formed symmetrically based on the concave portion.

13. The gas furnace of claim 1, further comprising;

a connector formed at one side of the mixing chamber, and the connector to connect to the mixing pipe; and an igniter which is positioned inside a combustion chamber closest to the connector among the plurality of combustion chambers, and is configured to ignite the mixture.

14. The gas furnace of claim 13, further comprising a flame detector which is positioned inside a combustion chamber disposed in a position farthest from a combustion chamber in which the igniter is installed among the plurality of combustion chambers, and is configured to detect whether the flame is generated.

15. The gas furnace of claim 1, further comprising:

an exhaust pipe that discharges combustion gas that passed through the heat exchanger to an outside; and an inducer that causes a flow of the mixture from the mixing pipe to the burner assembly, and causes a flow of the combustion gas from the burner assembly to the heat exchanger and the exhaust pipe.

16. The gas furnace of claim 1, further comprising:

a mixer that forms the mixture by mixing air and fuel gas introduced from each of an intake pipe and a manifold, wherein the mixer comprises:

a mixer housing having a front end to which the intake pipe is connected, a rear end to which the mixing pipe is connected, and a side surface to which the manifold is connected; and a venturi tube located inside the mixer housing.

17. The gas furnace of claim 16, wherein the venturi tube comprises:

a converging section having one end in which an inlet through which the air passed through the intake pipe flows is formed;

a throat which is connected to the converging section, and has a fuel inflow hole, through which fuel gas passed through the manifold is introduced, that is formed in at least a portion of a side surface; and a diverging section which is connected to the throat, forms and flows a mixture by mixing air and fuel gas passed through each of the converging section and the fuel inflow hole, and has one end in which a discharge portion for discharging the mixture to the mixing pipe is formed.

18. The gas furnace of claim 17, wherein the converging section is formed to decrease in diameter toward a downstream direction, wherein the diverging section is formed to increase in diameter toward the downstream direction.

* * * * *